US005667447A

United States Patent [19]

Perham et al.

[11] Patent Number: 5,667,447

[45] Date of Patent: Sep. 16, 1997

[54] SWING AID AND METHOD

[75] Inventors: George James Perham, 207 Lord Street, Lockridge, Western Australia; Anthony John Aslett, 61 Comic Court Circle, Byford, Western Australia; Nicholas Bootsma, Lynwood, all of Australia

[73] Assignees: George James Perham, Lockridge; Anthony John Aslett, Byford, both of Australia

[21] Appl. No.: 481,308

[22] PCT Filed: Dec. 31, 1993

[86] PCT No.: PCT/AU93/00689

§ 371 Date: Oct. 18, 1995

§ 102(e) Date: Oct. 18, 1995

[87] PCT Pub. No.: WO94/15681

PCT Pub. Date: Jul. 21, 1994

[30] Foreign Application Priority Data

Dec. 31, 1992 [AU] Australia ..... PL6623
May 18, 1993 [AU] Australia ..... PL8859

[51] Int. Cl.[6] ..... A63B 69/36

[52] U.S. Cl. ..... 473/212; 473/409

[58] Field of Search ..... 473/214, 212, 473/213, 409

[56] References Cited

U.S. PATENT DOCUMENTS

| | | | |
|---|---|---|---|
| 2,809,042 | 10/1957 | Wasley | 473/214 |
| 3,884,478 | 5/1975 | Buzan | 273/54 B X |
| 4,193,065 | 3/1980 | Bittner | 340/323 R |
| 4,392,830 | 7/1983 | Salzman et al. | 434/258 |
| 4,527,982 | 7/1985 | Salzman et al. | 273/29 A X |
| 5,149,085 | 9/1992 | Sanchez | 273/1.5 |

FOREIGN PATENT DOCUMENTS

| | | |
|---|---|---|
| 1 148 186 | 6/1983 | Canada . |
| 221106 | 2/1994 | China . |

OTHER PUBLICATIONS

*Enterprise*, "Innovations, A Market Place for Innovative Products, Ideas and Investments", vol. 4, No. 3, p. 60.

*Primary Examiner*—George J. Marlo
*Attorney, Agent, or Firm*—Merchant, Gould, Smith, Edell, Welter & Schmidt, P.A.

[57] ABSTRACT

A golf swing aid apparatus (FIG. 1) a flexure sensing device (12) for an articulated member and a movement sensing device (13) for sensing angular movement of a limb relative to a body to which it is attached. The device (12) has supports (23*a*, 23*b*) attached to either side of the joint of the articulated member, a flexure sensor (12') extending between the supports and a transducer. The flexure sensor is capable of expanding from a first position to a second position and then to a third position in response to different degrees of flexure of the articulated member and contracting back to the second and first positions in response to straightening of the member. The transducer is driven by a circuit (14, FIG. 4) to generate a signal in response to a predetermined expansion of the sensor to the second position and cease generating the signal in response to further predetermined expansion to the third position. The device (13) has a support (23*a*) to attach to the proximal end of a limb, a body contactor (31) mounted to the support, a contact sensor (13') and a transducer. The body contactor is disposed to contact the body whilst the limb is disposed at a prescribed angular position relative to the body. The contact sensor senses the contact between the body contactor and the body and the circuit (14) drives the transducer to generate a signal in response to the contact sensor sensing a prescribed loss of contact between the body contactor and the body. The apparatus incorporates both devices to aid a golfer in perfecting their golf swing.

40 Claims, 4 Drawing Sheets

SWING AID AND METHOD

This invention relates to movement sensing device which has particular, but not exclusive utility in a golf swing aid apparatus, and to a golf swing aid apparatus per se.

One of the most difficult actions for the human body to perfect, and maintain perfection of, is the swinging action of the arms required for swinging a golf club in the game of golf. Although the basic object of the game of golf is relatively simple, ie. hitting a ball with a club into a hole, the technique of properly executing a golf swing is a most difficult action to perfect due to the need to combine two opposing factors, one being power (and hence speed) and the other being precision.

It is considered by many golfing professionals that the most common faults that occur in a golf swing are a failure to keep the upper portion of the leading arm close to the torso and bending of the leading elbow during the stroke.

Accordingly, it is an object of one aspect of the present invention to provide an apparatus which warns the golfer in a simple and convenient way, of the failure to keep the upper portion of the leading arm close to the body, or additionally, of bending of the elbow of the leading arm during the golf stroke.

Indeed, as a consequence of the development of the invention as a golf swing aid, it has been determined that aspects of the invention have quite separate and broader definition, than simply as a golf swing aid, having utility in the areas of physiology, mechanical engineering and the like.

Accordingly, it is a broad object of the invention to provide a movement sensing device of a form which is able to sense angular movement of a limb relative to a body to which the limb is hingedly attached.

In accordance with one aspect of the present invention, there is provided a movement sensing device for sensing angular movement of a limb relative to a body to which it is attached comprising:

support means for attachment to said limb proximate to the proximal end of the limb;

contact means mounted to said support means and disposed to contact the body whilst the limb is disposed at a prescribed angular position relative to the body;

sensing means for sensing the contact of said contact means with the body; and transducer means for generating a signal in response to said sensing means sensing a prescribed loss of contact between said contact means and the body.

Wherein, said contact means is elongated and is adapted for positioning such that the longitudinal extent thereof is disposed transversely of the limb to maintain contact with the body throughout a range of angular movement of the limb adjacent to and across the body, whilst maintaining the relative angular displacement between the limb and the body, and to mitigate contact with the body in response to the limb moving away from the body increasing the relative angular displacement between the limb and the body.

In the case of a prescribed degree of such movement away from the body, contact between the contact means and the body is lost.

Preferably said contact means is adapted to provide for a differential change in contact relative to the degree of movement of the limb away from the body, and wherein said prescribed loss of contact corresponds to a prescribed degree of said movement.

Preferably, where the limb is articulated about a joint, the movement sensing device includes a flexure sensing device for the limb comprising:

further support means for attaching to either side of the joint of the limb, one part of said support means being adapted for attaching to one side of the joint and the other of said pair to the other side of the joint;

further sensing means for interconnection between the parts of said further support means, said further sensing means being capable of expanding from a first position in response to flexure of the limb to and beyond a second position and contracting back to said first position in response to straightening of the limb; and further transducer means for generating a further signal in response to a predetermined expansion of said sensing means to said second position.

Preferably, said further sensing means comprises: an actuating arm connected at one end to said one part of said further support means; a resilient arm connected at one end to said other part of said further support means, the other ends of said actuating arm and said resilient arm being interconnected; and electrical contact means associated with said actuating arm; wherein said electrical contact means are open when said further sensing means, actuating arm and resilient member is disposed at said first position and are closed when said further sensing means, actuating means and resilient arm are disposed at said second position; and wherein the closing of the electrical contact means triggers actuation of said further transducer means.

Preferably, said further sensing means is capable of expanding from said second position to and beyond a third position, in response to further flexure of the limb, wherein said further transducer means is actuated to cease generating said further signal in response to a further predetermined expansion of said further sensing means to said third position.

Preferably, further electrical contact means are associated with said actuating arm, wherein said further electrical contact means are open when said further sensing means, actuating arm and resilient arm are disposed at both said first and second positions, and are closed when said further sensing means, actuating arm and resilient arm are disposed at said third position; wherein the closing of the further electrical contact means deactivates said further transducer means.

In accordance with a further aspect of the present invention, there is provided an apparatus for aiding a golf swing or the like including:

a movement sensing device comprising: support means for attaching proximate to the proximal end of the leading arm of a user of the apparatus, adjacent to the body of the user; sensing means mounted to said support means for sensing a loss of contact between the upper portion of the leading arm and the body; and transducer means for generating a further signal in response to a prescribed loss of contact sensed by said sensing means; and a flexure sensing device comprising further support means for attaching to the leading arm of the user adjacent to or coincident with the elbow thereof; further sensing means mounted to said further support means for sensing flexure between the upper and lower portions of the leading arm about the elbow; and further transducer means for generating a further signal in response to a prescribed flexure sensed by said further sensing means;

wherein said movement sensing device and said flexure sensing device are interconnected to function conjointly and co-operatively with each other.

In accordance with another aspect of the present invention, there is provided a method for aiding a golf swing or the like comprising:

fitting a support to the leading arm of the user proximate to the proximal end of the arm adjacent to the body of the user;

sensing any loss of contact between the upper portion of the leading arm and the body throughout a range of movement of the leading arm adjacent to and across the body during a golf swing; and generating a signal in response to sensing a prescribed loss of contact between the upper portion of the leading arm and the body at any time during a prescribed range of movement of the leading arm during the golf swing.

Preferably, the method includes also fitting a support to the leading arm of the user adjacent to or coincident with the elbow thereof; sensing flexure of the elbow during movement of the leading arm throughout a golf swing; and generating a further signal in response to flexure of the arm beyond a prescribed degree.

Preferably, the method includes ceasing generation of the further signal in response to flexure beyond a prescribed upper limit.

The invention will be better understood in light of the following description of one specific embodiment thereof. The description is made with reference to the accompanying drawings, wherein.

Figure 5B:
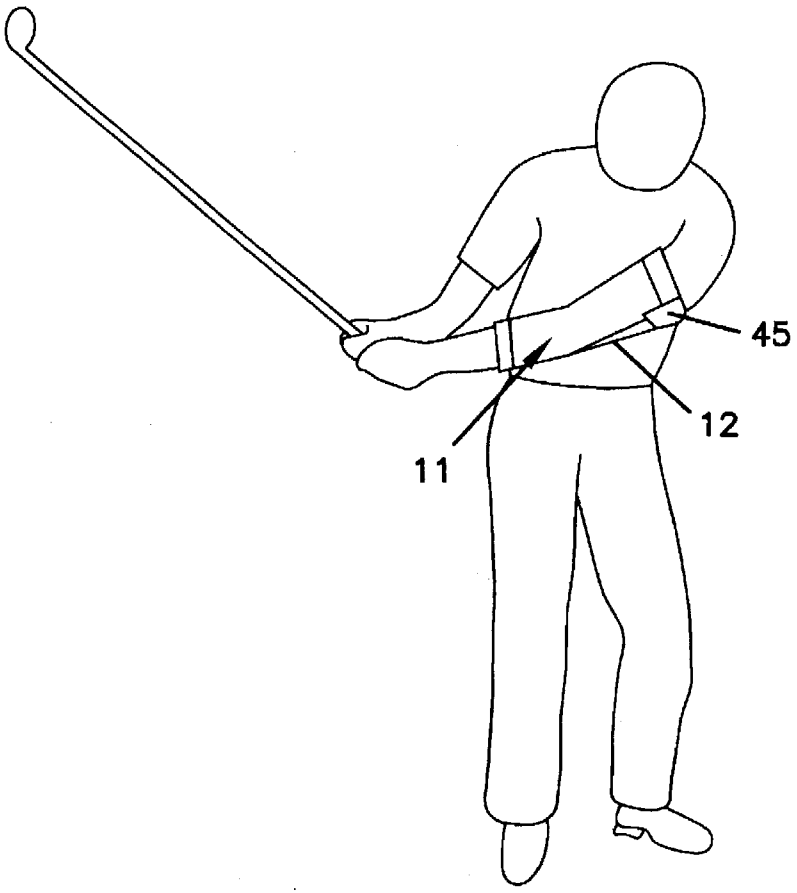
FIG. 5*a* is a front view showing the sleeve of the apparatus in position on the leading arm of a user thereof, covering the upper arm and elbow of the user in the address position.
Figure 5A:
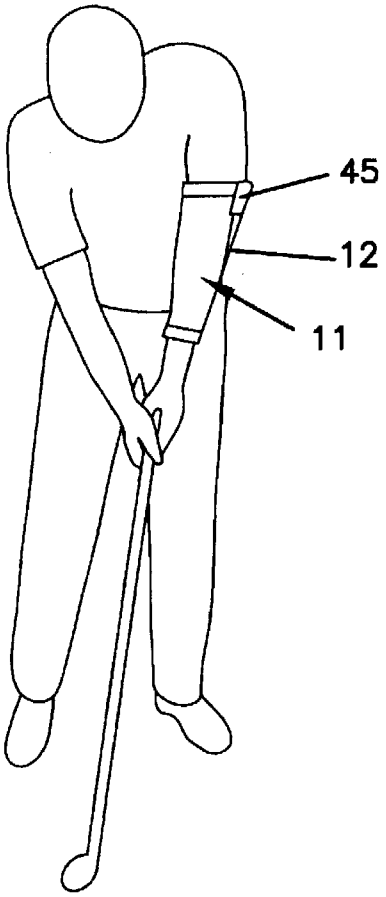

FIG. 5*b* is a similar view to FIG. 5*a* but showing the user with the golf club at an intermediate stage of the back swing.

The embodiment is directed towards a golf swing aid apparatus which is able to be worn on the arm of a user, being a golfer performing the golf swing in practice. The apparatus includes a movement sensing device for sensing loss of contact of the upper arm with the body and a flexure sensing device for sensing flexure of the arm.

The well executed golf swing used for a tee shot, fairway shot or any other golf shot which necessitates that the arms be fully extended (e.g. not quick uplift shots such as from heavy rough where bending of the leading arm may be required etc) can be divided into three parts: the back swing, down swing and follow through. The important control characteristics of the golf swing occur in the back swing and down swing where the leading arm of the golfer (the left arm for right handed golfers) should remain straight, and the upper portion of the leading arm should remain close to the body. In the follow through, the leading arm bends, while the upper portion of the leading arm moves away from the body. By notifying the golfer of bending or flexing of the elbow of the leading arm, or loss of contact between the upper portion of the leading arm and the body, the apparatus helps the golfer to correctly use the left arm.

In the present embodiment, the apparatus essentially comprises a support means including a sleeve 11, an elbow flexure sensing device 12, an upper arm movement sensing device 13 and an electronic circuit 14.

The sleeve 11 provides a support for incorporation with the flexure sensing device 12 and the movement sensing device 13. It is made of one way stretch material arranged into two layers and is of a size to fit upon a user's arm. The sleeve 11 is intended to be disposed on the arm so that it covers the elbow and extends a marginal distance along the lower portion of the arm below the elbow and also in the other direction along the upper portion of the arm above the elbow to terminate proximate to the proximal end of the arm. The main direction of stretch is transverse to the longitudinal extent of the sleeve, so that it can fit upon a variety of differently sized arms whilst maintaining a fixed length.

The sleeve is provided with a pair of cuffs, one cuff 15*a* being disposed at the upper part of the sleeve and the other cuff 15*b* being disposed at the bottom part of the sleeve. Plastic inserts 23*a* and 23*b* are respectively incorporated into the upper and lower cuffs 15*a* and 15*b*, between the two layers of the sleeve to reinforce the cuffs so as to prevent distortion when pulling either cuff to locate or remove the sleeve upon the arm of the wearer. In addition, tabs 16*a* and 16*b* are incorporated into the upper and lower cuffs 15*a* and 15*b*, at one side of the sleeve to facilitate pulling of the sleeve when locating it on, or removing it from, the arm. The plastic inserts 23 extend transversely a portional distance along the cuffs and also project partly longitudinally of the sleeve between the layers thereof to provide some stability to the sleeve in creating a hole at either end so as to facilitate inserting the arm through the sleeve. In addition, they provide a reasonably rigid support on which the remaining parts of the apparatus may be attached or mounted.

The flexure sensing device 12 includes support means provided by the sleeve 11, flexure sensing means 12' extending between the opposing ends of the sleeve 11, and transducer means incorporated into the electronic circuit 14.

The sleeve 11 incorporates the plastic inserts 23 so that the respective longitudinal portions of the inserts, one portion being associated with the upper insert 23*a* and the other portion being associated with the lower insert 23*b*, are disposed in alignment. Accordingly, the flexure sensing means 12' is disposed between the two layers of the sleeve 11 and can be disposed to extend along the arm over the outside of the elbow when the sleeve is correctly positioned upon the arm, by simply adjustment of the sleeve.

The flexure sensing means 12' comprises a tubular housing 22, an actuating arm 17, a resilient arm, and electrical contact means. The housing 22 is fixedly attached to a longitudinal part of the upper plastic insert 23*a*, so that it projects longitudinally along the sleeve.

The actuator arm 17 comprises a tension spring 21 fixed at one end to the upper end of the housing 22, within the bore thereof (and thereby is connected to the upper insert 23*a*) and a rod 25 provided with a pair of eyes 25*a* and 25*b* at either end. One inner eye 25*a* is connected to the other end of the spring 21 so that the rod 25 extends axially along the bore and the other outer eye 25*b* projects outwardly from the bore at the lower end of the housing 22. The rod 25 has mounted thereon a pair of insulative sleeves 26*a* and 26*b*, one inner sleeve 26*a* disposed around the stem of the rod 25 adjacent to the inner eye 25*a* and the other outer sleeve 26*b* disposed around the stem of the rod 25 adjacent to the outer eye 26*b*. These sleeves 26*a* and 26*b* form insulative spacers between the rod 25 and the contact means, for a purpose which should become evident later.

The resilient arm is in the form of an elastic strap 24. The elastic strap 24 is connected at one end to the lower plastic insert 23b, which constitutes the other of the support means, and at the other end to the outer eye 25b at the other end of the actuating arm 17. In this manner, the other ends of both the actuating arm 17 and resilient arm are interconnected so that the flexure sensing means 12' extends longitudinally between the opposing ends of the sleeve 11, and by correct positioning of the sleeve, can be disposed over the elbow of the leading arm.

Figure 2:
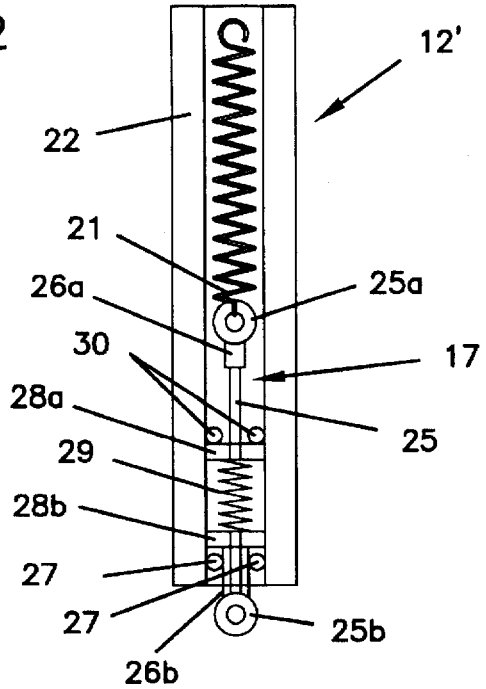
FIG. 2 is a fragmentary side elevation of part of the sensing means for the flexure sensing device.

The electrical contact means is reasonably complex, comprising a pair of outer contacts 27, an inner contactor 28a, a outer contactor 28b, a compression spring 29 disposed between the contactors 28a and 28b, and a pair of inner contacts 30, all disposed circumferentially around the rod 25 in discrete axially spaced positions, as shown in FIG. 2 of the drawings.

Figure 4:
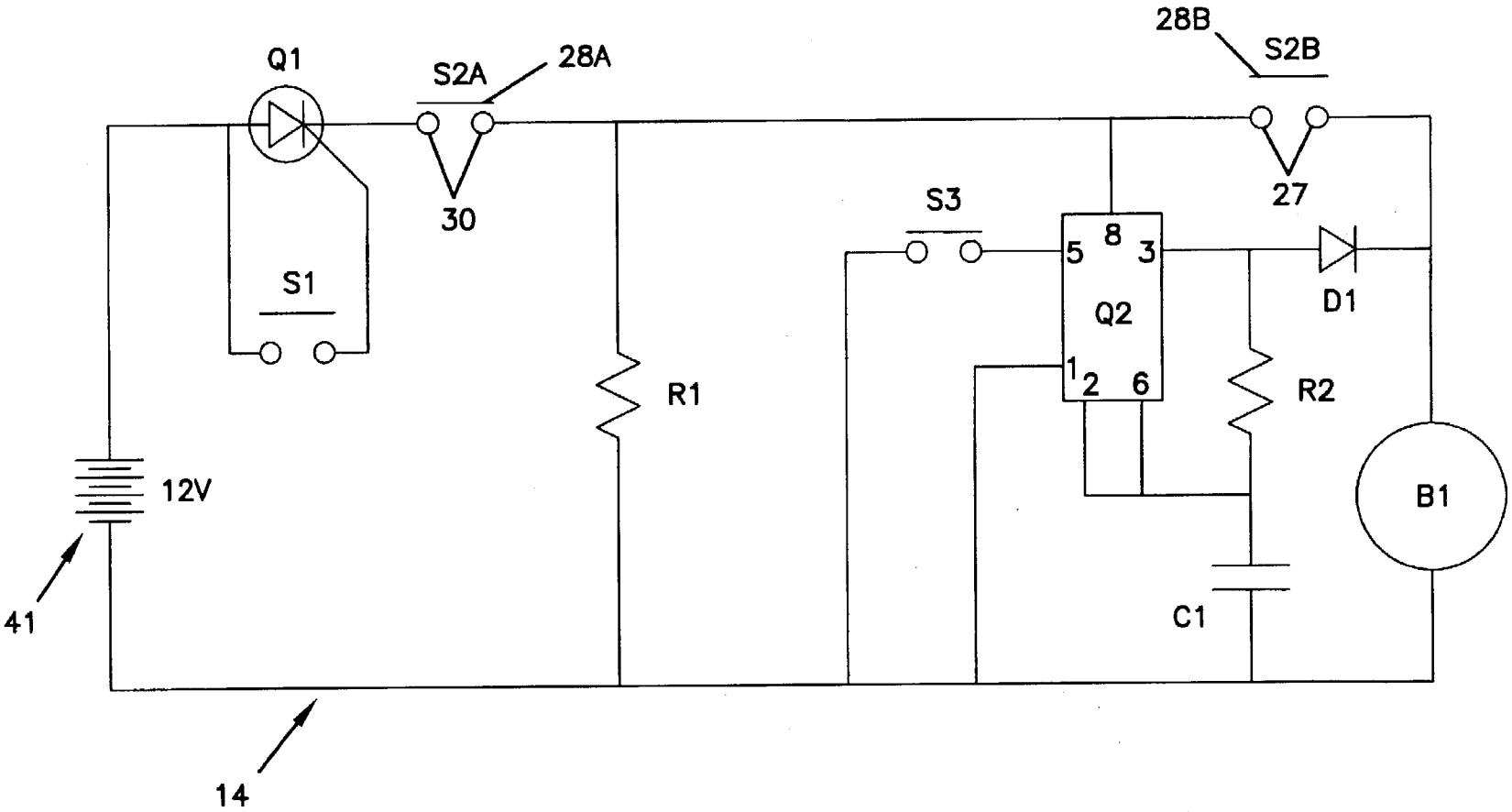
FIG. 4 is a circuit diagram of the electronic circuit used in the golf swing aid apparatus.

The contacts 30 and 27 comprise the poles of two switches S2*a* and S2*b* respectively of the electronic circuit 14 shown in FIG. 4 of the drawings. Accordingly, the switch S2*a* is closed or opened by the position of the inner contactor 28a and the switch S2*b* is closed or opened by the position of the outer contactor 28b.

The contactors 28a and 28b are respectively mounted to opposing ends of the compression spring 29 which is disposed to move axially along the stem of the rod 25 so that the inner contactor 28a is disposed towards the inner eye 25a and inner sleeve 26a of the actuating arm and the outer contactor 28b is disposed towards the outer eye 25b and outer 26b of the arm.

The contacts 27 are fixedly disposed within the bore of the housing 22 adjacent to the outer end thereof, so that when the actuating arm 17 is correctly disposed within the housing 22, the contacts 27 are disposed intermediate the outer eye 25b and the outer contactor 28b. The contacts 30 are fixedly disposed within the bore of the housing 22, sufficiently inwardly spaced from the contacts 27 so that the compression spring 29 with the contactors 28a and 28b can move axially along the stem of the rod 25 between the two contacts 27 and 30. In this manner, the contacts 30 are disposed intermediate the inner contactor 28a and the inner eye 25a of the actuating arm.

The contactors 28a and 28b are of annular shape having an inner diameter marginally larger than the stem of the rod 25, to facilitate axial movement therealong, but marginally less than the outer diameter of the sleeves 26a and 26b. Consequently, axial movement of the contactors 28a and 28b relative to the rod 25 and the contacts 27 and 30 is limited so that the contactors 28a and 28b remain spaced from the stem of the rod 25 and the eyes 25a and 25b, when the contactors 28a and 28b are spaced from their respective contacts 30 and 27. Thus opening and closing of the switches S2*a* and S2*b* is determined entirely by contact or breaking of contact between the contactors 28a and 28b and the contacts 30 and 27.

The spacing between the contacts 27 and 30 is such that when the compression spring 29 is disposed towards its uncompressed state, the contactors 28a and 28b are biased into contact with the corresponding contacts 30 and 27 respectively. Furthermore, the tension spring 21, the rod 25 and the elastic strap 24 are all specifically dimensioned so that in the absence of a tensile force applied by the elastic strap 24, the actuating arm 17 is disposed in a resting or contracted position as shown in FIG. 2. In this position, the tension spring 21 applies sufficient tension to the rod 25 to cause the outer plastic sleeve 26b to bear upon the outer contactor 28b and compress the compression spring 29 sufficiently to break contact with the outer contacts 27 whilst bearing of the inner contactor 28a upon the inner contacts 30 in maintained. This contracted position of the flexure sensing means 12' corresponds to a first position of operation of the device.

Upon a tensile force being applied to the elastic strap 24, caused by an expansion of the sensing means arising from a flexure of the arm, the actuating arm 17 will move axially along the bore, releasing compression of the compression spring 29 to a degree, allowing the outer contactor 28b to engage the outer contacts 27, enabling electrical contact therebetween. This corresponds to a second position of operation of the device, where both contacts 30 and 27 are closed corresponding to closure of both switches S2*a* and S2*b* respectively.

It should be noted that this second position of operation will be maintained until a sufficiently large tensile force is applied to the actuating arm 17, which causes axial movement of it along the bore until the inner plastic sleeve 26a bears upon the inner contactor 28a, breaking contact between it and the inner contacts 30. This corresponds to a third position of operation of the device, where the outer contacts 27 will still be closed by the compression spring maintaining the bearing of the outer contactor 28a upon the outer contacts 27 and the inner contacts 30 will be open, hence causing switch S2*a* to open and switch S2*b* to remain closed.

These different positions of operation have an important effect on the operation of the electronic circuit 14, which will be described in more detail later.

The upper arm movement sensing device 13 includes support means provided by the sleeve 11 and the upper plastic insert 23a, contact means 31, contact sensing means 13' and transducer means incorporated into the electronic circuit 14. The movement sensing device is mounted to the upper plastic insert 23a of the sleeve 11 so that the device can be attached to the upper portion of the arm proximate to the proximal end thereof with respect to the body of the user. That portion of the upper plastic insert 23a supporting the movement sensing device 13 is disposed approximately 90° from the one portion of the upper plastic insert 23a supporting the flexure sensing device 12. In this manner, the movement sensing device 13 can be disposed underneath the arm of the user and the flexure sensing device 12 disposed to extend around the outside of the elbow of the user at the same time, upon correct fitting of the sleeve along the arm.

Figure 3A:
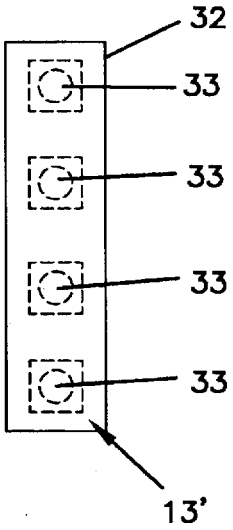
FIG. 3 is a sectional side elevation shown at FIG. 3*a* and plan view shown at FIG. 3*b* of the sensing means for the movement sensing device.
Figure 3B:
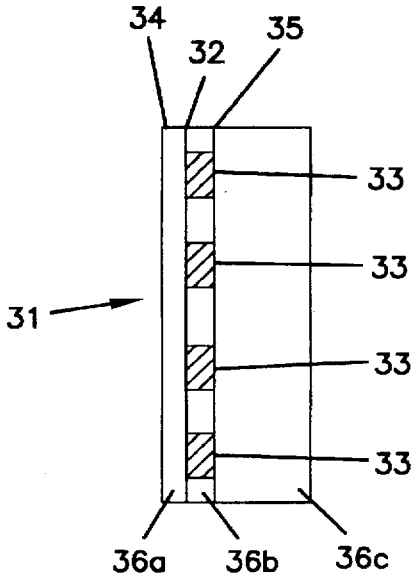

The contact means 31 is of laminated form, comprising a base 34 of flexible material, a flexible switch holder 32, a switch activation sheet 35 and a series of layers of foam rubber which are respectively sandwiched between the base 34, switch holder 32 and activation sheet 35 as shown in FIG. 3 of the drawings to space them apart and form a pressure switch.

The base 34 is mounted directly upon a portion of the plastic insert 23a and is separated from the flexible switch holder 32 by the first layer 36a of foam rubber. The flexible switch holder 32 provides a base on which the contact sensing means 13' is disposed and is separated from the switch activation sheet 35 by the second layer 36b of foam rubber. The switch activation sheet 35 cooperates with the contact switching means 13' and combines with an outer layer 36c of foam rubber attached to the outer surface thereof to provide a medium by which contact between the outer surface of the movement sensing device 13 and the body of the user can be sensed by the contact sensing means 13'.

The contact sensing means 13' comprises a plurality of open membrane switches 33 which are interposed between the flexible switch holder 32 and the flexible activation sheet 35.

The contact means 31 is elongated and is positioned upon the support means such that the longitudinal extent thereof is disposed transversely along the upper cuff 15*a* of the sleeve. This is provided so that contact between the contact means 31 and the body of the user can be maintained throughout a range of angular movement of the arm relative to the body, in accordance with the correct movement of the leading arm during a golf swing. Consequently, the membrane switches 33 are disposed in sequence at spaced apart locations extending from one end of the contact means to the other, in a generally longitudinal arrangement.

Importantly, the laminated arrangement of the foam rubber provides for increased sensitivity of the contact means in responding to pressure applied by the contact between the outer periphery of the contact means and the body in response to the upper arm being kept in contact with the body. Furthermore, the laminated arrangement provides for sensing of a differential change in pressure between the contact means and the body to enable a threshold level of sensitivity to be established equating to a prescribed loss of contact between the upper arm and the body, which in turn corresponds to a prescribed degree of angular movement of the upper portion of the arm away from the body.

The membrane switches 33 in the present embodiment are each connected in parallel to constitute a switch S3 of the electronic circuit as shown in FIG. 4 of the drawings. Accordingly, when any one of the switches 33 are closed, sensing a prescribed degree of contact between the upper arm and the body, the switch S3 is closed.

The transducers for both the flexure sensing device 12 and the movement sensing device 13 are implemented by a single buzzer B1 incorporated into the electronic circuit 14 as shown in FIG. 4 of the drawings. The electronic circuit 14 would ideally be embodied in integrated form, but obviously can be embodied in a number of different ways depending upon the particular design criteria applied.

Figure 1C:
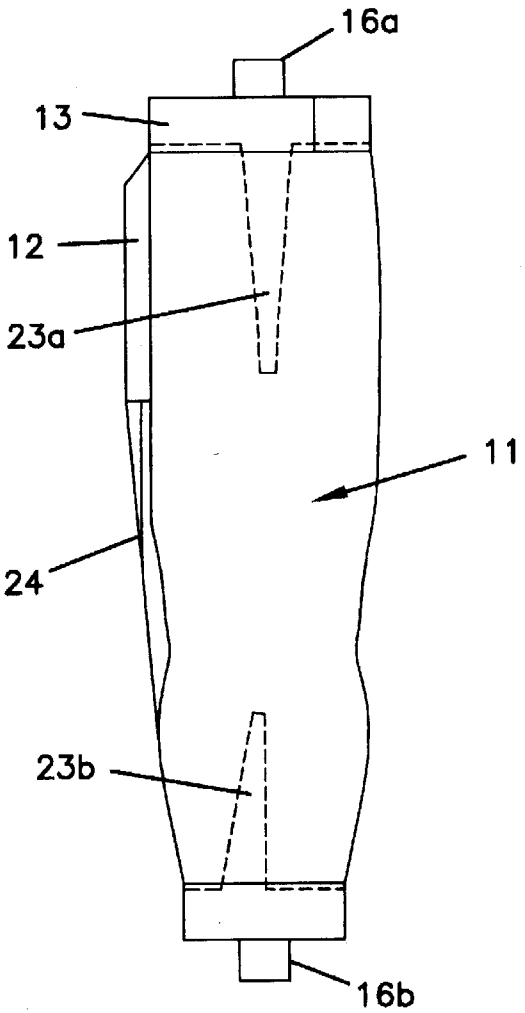
FIG. 1 is a series of side views showing the sleeve of the apparatus, including a left view shown at FIG. 1*a*, a back view shown at FIG. 1*b*, and a right view of the sleeve shown at FIG. 1*c*.
Figure 1B:
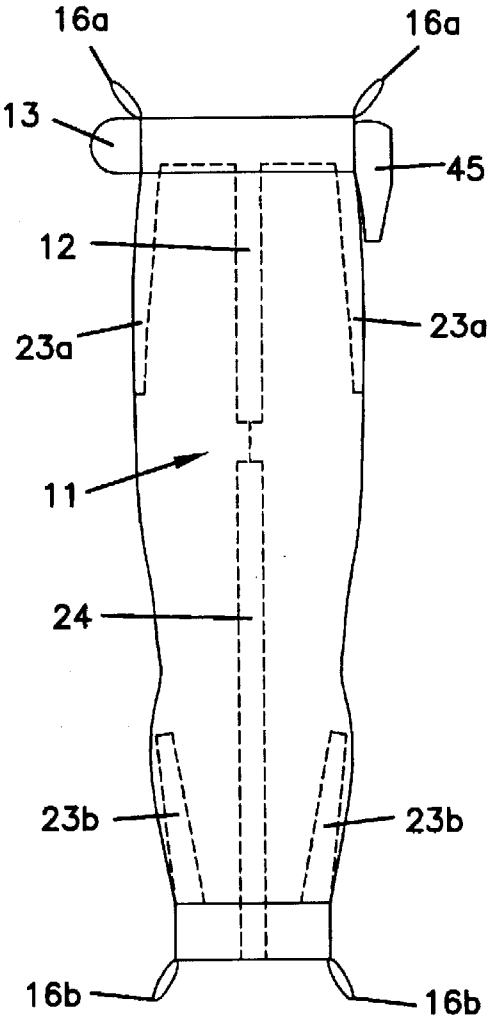
Figure 1A:
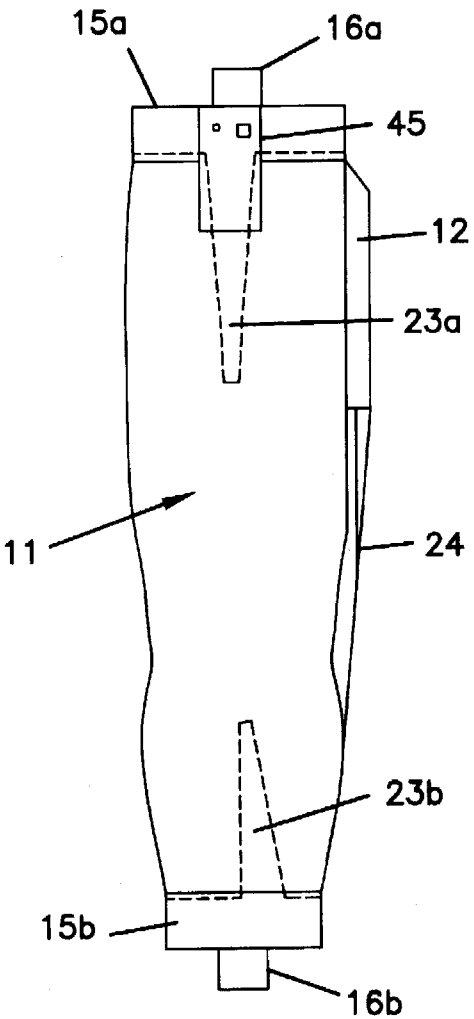

In the case of embodiment with discrete electronic components on a printed circuit board, the electronic circuit 14 together with a battery 41 is housed within an appropriate casing 45, which in the present embodiment is also amounted upon support means provided by the upper plastic insert 23*a*, along the upper cuff 15*b* of the sleeve. As shown in FIG. 1 of the drawings, the casing 45 is disposed along the cuff 15*a* diametrally opposite to the movement sensing device 13 and hence approximately 90° to the positioning of the flexure sensing device 12.

The operation of the buzzer B1 in accordance with the operation of the flexure sensing device 12 and the movement sensing device 13 is controlled by the electronic circuit 14. Power to the circuit is provided by a 12 volt battery 41 which is connected into or out of the circuit by a momentary action switch S1, a silicon controlled rectifier (SCR) Q1 and the switch S2*a*.

The switch S1 is incorporated into the casing 45 so that when the casing is compressed by finger pressure, the switch is momentarily closed. The switch S1 is connected across the gate and anode terminals of the SCR Q1, which in turn are both connected in series with the battery 41 and the switch S2*a* for switching power to, or disconnecting power from, the remainder of the circuit 14, depending upon the state of the SCR Q1.

Accordingly, momentary closure of the switch S1 forward biases the gate-cathode function of the SCR Q1 allowing current to flow therethrough via the anode-cathode junction.

The switch S2*a* is connected in series with the SCR Q1 so that opening of the switch S2*a* interrupts the current flow to the circuit, switching off the SCR until the next trigger pulse is received from the momentary acting switch S1.

The remaining circuitry comprises switch S3 and an integrated timing circuit Q2 for use with the movement sensing device 13, switches S2*a* and S2*b* for use with the flexure sensing device 12, and the buzzer B1.

The timing circuit is designed to generate a pulse train with a frequency of approximately 2 hertz, which is output via pin 3 for the purposes of driving the buzzer B1 in response to opening of the switch S3. The timing circuit Q2 is in the form of a CMOS 555 timer. The switch S3 is connected to the control voltage pin 5 of the timing circuit Q2, and an isolating diode D1, timing resistor R2 and timing capacitor C1 are configured and connected to the output pin 3 and the trigger and threshold pins 2 and 6 respectively, so that the 555 timer operates as an astable multivibrator.

Accordingly, when power is supplied to the timing circuit at pin 8, dependent upon the operation of the switch S1 and in response to the switch S2*a* being closed, operation of the upper arm movement sensing device 13 effects operation of the switch S3 by opening or closing of any one of the membrane switches 33, which subsequently effects operation of the timing circuit Q2 to drive the buzzer B1. Moreover, if the switch S3 is closed as a result of the contact sensing means signifying contact between the upper arm and body, the control voltage pin 5 of the 555 timer is pulled low, grounding the timing capacitor C1 and thus preventing any output from the output pine 3. The timing resistor R2 and timing capacitor C1 are chosen such that current drain is minimal while obtaining reliable operation of the timing circuit Q2. Opening of the switch S3, which arises as a result of the contact sensing means 13' sensing a prescribed loss of contact between the upper arm and the body, will allow the timing capacitor C1 to function normally, which allows the 2 hertz pulse train to be output from the output pin 3, operating the buzzer B1 to provide a bussing sound which is pulsed at 2 hertz.

The switches S2*a* and S2*b* are arranged so as to bypass the integrated timing circuit Q2 when effecting operating of the buzzer B1 in accordance with the operation of the flexure sensing device 12. The switch S2*a* however performs an additional overriding function with respect to the switch S3 and indeed the entire circuit. Moreover, when the switch S2*a* is open, the SCR Q1 is turned off, ceasing the power supply to the timing circuit Q2, and hence overriding the operation of both the switch S3 and switch S2*b*. Thus, the timing circuit Q2 and hence the upper arm movement sensing device 13, only operates whilst the switch S2*a* is closed, which will occur only whilst the flexure sensing device 12 operates in the first and second positions. As previously described, the switch S2*a* will remain closed until there is a sufficiently large flexure of the leading arm, corresponding to the third position of operation. This third position is set to coincide with the follow through phase of the swing, at which time the sensing of both the upper arm movement sensing device 13 and flexure sensing device 12 are no longer necessary.

As previously described, closure of the switch S2*a* corresponds to the inner contactor 28*a* closing the inner contacts 30, which will occur when the flexure sensing means 12' is in its contracted or first position and at which position the switch S2*b* will be opened. That is the outer contactor 28*b* will be spaced from the outer contacts 27. At this position, the opening of the switch S2*b* prevents current flow to the buzzer B1 whilst switch S3 is closed, signifying the correct position of the arm. Slight flexure of the arm from this straightened position will cause expansion of the flexing sensing means to the second position, at which position the switch S2*b* is closed by the outer contactor 28*b* engaging the outer contacts 27. At this second position, the switch S2*a* will still be closed by the major effect of the tension spring 21 on the rod 25, whereby the slight flexure of the arm is translated into releasing pressure upon the compression spring 29, allowing it to push both contactors 28*a* and 28*b* into respective engagement with the contacts 30 and 27. With the switch S2*b* closed, current will flow through to the buzzer B1, actuating the same to provide a continuous buzzing sound and will remain until such time as the switch S2*b* opens again, or until such time as the switch S2*a* opens.

If the switch S3 is open whilst the switches S2*a* and S2*b* are closed, the integrated timing circuit Q2 will nonetheless be activated, but in effect be overridden by the continuous current flow to the buzzer B1 sourced via the switches S2*a* and S2*b*.

The diode D1 is connected with its anode in series to the output pin 3 of the 555 timer and the timer resistor R2, and with its cathode to the input to the buzzer B1. In this manner it prevents interaction between the output of the flexure sensing device 12, which is connected to the buzzer B1 via the switch S2*b*, and the output (pin 3) of the movement sensing device 13.

Now describing the operation of the apparatus, firstly the sleeve 11 is positioned upon the leading arm of the user with the contact means of the movement sensing device 13 disposed beneath the portion of the leading upper arm so as to engage the body of the user and the flexure sensing means 12' is disposed over the outside of the elbow. The apparatus is operated by pressing the casing 45 housing the electronic circuit 14, whereupon if the arm is not disposed in contact with the body, the upper arm movement sensing device 13 will actuate the buzzer B1 to produce an oscillating tone via the operation of the integrated timing circuit Q2. Alternatively, if the leading arm is not straight, the flexure sensing device 12 will actuate the buzzer B1 to produce a single audible tone. Upon correcting either deficiency, the buzzer will cease sounding, signifying to the user that the leading arm is in the correct position to perform the golf swing.

Whilst the user progresses through the backswing and downswing stages of the golf swing, both the upper arm movement sensing device 13 and the flexure sensing device 12 sense any deviation from their resting sensing states, and activate the buzzer B1 if such a deviation is noted. In the performance of a correct backswing and downswing, the buzzer will not sound, signifying that the arm position has been maintained at the correct position throughout these stages of the golf swing.

Upon entering the follow through stage of the golf swing, the leading arm will cease contacting the body of the user, and will also flex in accordance with the usual positioning of the leading arm during follow through. This will cause a short sounding of the buzzer until it is overridden by the arm flexing beyond an upper threshold (the third position) at which point the switch S2*a* will be open, deactuating the buzzer B1 by ceasing the supply of power to the integrated timing circuit Q2 or to the switch S2*b*.

The sensitivity of the flexure sensing device and the movement sensing device is determined by the mere positioning of the sleeve upon the arm. Moreover, in the case of the flexure sensing device, sensitivity is maximised by stretching the opposing cuffs apart to their maximum before activating the buzzer, when the leading arm is disposed in the extended position. This tensions the elastic strap 24.

It should be appreciated that the scope of the present invention is not limited to the particular embodiment herein described. Importantly, the invention is not limited to application in aiding a golf swing, but can be embodied in an appropriate form to provide sensing in other areas of use. In addition, the invention as embodied in the form of a golf swing aid apparatus is not limited to implementation with the specific arrangements of the sensing means and the electronic circuit as described, and accordingly other implementations of these sensing means may be provided in accordance with improved design engineering, without necessarily departing from the scope of the present invention.

We claim:

1. An apparatus for aiding motion similar to a golf swing including a movement sensing device comprising: support means for attaching proximate to the proximal end of the leading arm of a user of the apparatus, adjacent to the body of the user; sensing means mounted to said support means for sensing a loss of contact between the upper portion of the leading arm and the body; and transducer means for generating a signal in response to a prescribed loss of contact sensed by said sensing means; and a flexure sensing device comprising further support means for attaching to the leading arm of a user adjacent to or coincident with the elbow thereof; further sensing means mounted to said further support means for sensing flexure between the upper and lower portions of the leading arm about the elbow; and further transducer means for generating a further signal in response to a prescribed flexure sensed by said further sensing means; and wherein said movement sensing device and said flexure sensing device are interconnected to function conjointly and cooperatively with each other.

2. An apparatus as claimed in claim 1, wherein said further sensing means comprises: an actuating arm connected at one end to said one part of said further support means; a resilient arm connected at one end to said other part of said further support means, the other ends of said actuating arm and said resilient arm being interconnected; and electrical contact means associated with said actuating arm; wherein said contact means are open when said further sensing means is disposed at said first position and are closed when said further sensing means is disposed at said second position; and wherein the closing of the electrical contact means triggers actuation of said further transducer means.

3. An apparatus as claimed in claim 2, wherein said actuating arm is expandable and contractible independently of said resilient arm, such that flexure of the elbow causes expansion of said resilient member which in turn causes expansion of said actuating arm, and straightening of the elbow causes contraction of said resilient member which in turn causes retraction of said actuating arm; and said electrical contact means are fixedly disposed relative to said further support means; whereby said actuating arm causes said electrical contact means to open below a prescribed threshold of expansion, corresponding to said further sensing means being disposed at said first position, and close beyond said prescribed threshold of expansion, corresponding to said further sensing means being disposed at said second position.

4. An apparatus as claimed in claim 3, wherein said electrical contact means comprises a first set of contacts axially disposed in conjunction with said actuator arm; and said actuator arm includes a contractor associated with said first set of contacts, said contractor being axially moveable in response to expansion or contraction of said actuator arm to selectively contact said first set of contacts to close or open said electrical contact means dependent upon the prescribed expansion or contraction of said actuator arm disposing said further sensing means in either said second or first positions.

5. An apparatus as claimed in claim 1, wherein said further sensing means is capable of expanding from said second position to and beyond a third position, in response to further flexure of the elbow, wherein said further transducer means is actuated to cease generating said further signal in response to a further predetermined expansion of said further sensing means to said third position.

6. An apparatus as claimed in claim 5, including further contact means associated with said actuating arm, wherein said further contact means are open when said further sensing means is disposed at either of said first and second positions, and are closed when said further sensing means is disposed at said third position; and wherein the closing of the further contact means deactivates said further transducer means.

7. An apparatus as claimed in claim 5, wherein said further contact means comprises a second set of contacts axially disposed in conjunction with said actuator arm and spaced apart a prescribed distance from said first set of contacts; and said actuator arm includes a further contactor also being moveable in response to expansion or contraction of said actuator arm selectively contact said second set of contacts to close or open said further contact means dependent upon the further prescribed expansion or contraction of said actuator arm disposing said further sensing means in either said second or third positions.

8. An apparatus as claimed in claim 7, wherein said contactor and said further contactor are relatively moveable with respect to each other to axially move in response to expansion or contraction of said actuator arm at different stages.

9. An apparatus as claimed in claim 1, wherein said actuating arm comprises tension spring means at said one end thereof and rod means at said other end thereof, whereby said tension spring means and said rod means are interconnected.

10. An apparatus as claimed in claim 9, wherein said contactor and said further contactor are interconnected by a compression spring means and are disposed intermediate said electrical contact means and said further contact means, which in turn are disposed intermediate the ends of said rod means.

11. An apparatus as claimed in claim 9, wherein said rod means comprises sleeves at either end to bear upon said contactor and said further contactor to move the same axially is response to relative movement of said actuator arm.

12. An apparatus as claimed in claim 1, wherein said further support means comprises a stretchable sleeve for fitting over and engaging the elbow, said one part of said further support means being fixedly disposed at one end of said sleeve, and the other part of said further support means being fixedly disposed at the opposing end of said sleeve.

13. An apparatus as claimed in claim 1 wherein said flexure sensing device further comprises one part of said support means being adapted to attach to one side of the elbow and the other part of said support means being adapted to attach to the other side of the elbow; and said sensing means being capable of expanding from a first position in response to flexure of the leading arm to and beyond a second position and contracting back to said first position in response to straightening of the leading arm; contact means mounted to said support means and disposed to contact the body whilst the arm is disposed at a prescribed angular position relative to the body.

14. An apparatus as claimed in claim 13 wherein said movement sensing device further comprises contact means mounted to said support means and disposed to contact the body whilst the arm is disposed at a prescribed angular position relative to the body.

15. An apparatus as claimed in claim 1, wherein said support means and said further support means are integrated.

16. An apparatus as claimed in claim 15, wherein said transducer means and said further transducer means are integrated.

17. A movement sensing device for sensing angular movement of a limb relative to a body to which it is attached comprising:

support means for attachment to said limb proximate to the proximal end of the limb;

contact means mounted to said support means and disposed to contact the body whilst the limb is disposed at a prescribed angular position relative to the body;

sensing means for sensing the contact of said contact means with the body; and transducer means for generating a signal in response to said sensing means sensing a prescribed loss of contact between said contact means and the body, wherein said contact means is elongated and is adapted for positioning such that the longitudinal extent thereof is disposed transversely of the limb to maintain contact with the body throughout a range of angular movement of the limb adjacent to and across the body whilst maintaining the relative angular displacement between the limb and the body, and to mitigate contact with the body in response to the limb moving away from the body increasing the relative angular displacement between the limb and the body.

18. A movement sensing device as claimed in claim 17, wherein said contact means is adapted to provide for a differential change in contact relative to the degree of movement of the limb away from the body, and wherein said prescribed loss of contact corresponds to a prescribed degree of said movement.

19. A movement sensing device as claimed in claim 17 or 16, wherein said support means comprises a stretchable sleeve for fitting over and engaging the limb.

20. A movement sensing device as claimed in claim 17, wherein the limb is articulated, the movement sensing device including flexure sensing means comprising:

further support means for attaching to either side of the joint of the limb, one part of said further support means being adapted to attach to one side of the joint and the other part of said further support means being adapted to attach to the other side of the joint;

further sensing means for interconnection between the respective parts of said further support means, said further sensing means being capable of expanding from a first position in response to flexure of the limb to and beyond a second position and contracting back to said first position in response to straightening of the limb; and further transducer means for generating a further signal in response to a predetermined expansion of said further sensing means to said second position.

21. A movement sensing device as claimed in claim 20, wherein said further sensing means is capable of expanding from said second position to and beyond a third position, in response to further flexure of the limb, wherein said further transducer means is actuated to cease generating said further signal in response to a further predetermined expansion of said further sensing means to said third position.

22. A movement sensing device as claimed in claim 21, including further contact means associated with said actuating arm, wherein said further contact means are open when said further sensing means is disposed at either said first and second positions, and are closed when said further sensing means is disposed at said third position; and wherein the closing of the further contact means deactivates said further transducer means.

23. A movement sensing device as claimed in claim 21, wherein said further contact means comprises a second set of contacts axially disposed in conjunction with said actuator arm and spaced apart a prescribed distance from said first set of contacts; and said actuator arm includes a further contactor also being moveable in response to expansion or contraction of said actuator arm selectively contact said second set of contacts to close or open said further contact means dependent upon the further prescribed expansion or contraction of said actuator arm disposing said further sensing means in either said second or third positions.

24. A movement sensing device as claimed in claim 23, wherein said contactor and said further contactor are relatively moveable with respect to each other to axially move in response to expansion or contraction of said actuator arm at different stages.

25. A movement sensing device as claimed in claim 20, wherein said actuating arm comprises tension spring means at said one end thereof and rod means at said other end thereof, whereby said tension spring means and said rod means are interconnected.

26. A movement sensing device as claimed in claim 25, wherein said contactor and said further contactor are interconnected by a compression spring means and are disposed intermediate said electrical contact means and said further contact means, which in turn are disposed intermediate the ends of said rod means.

27. A movement sensing device as claimed in claim 25, wherein said rod means comprises sleeves at either end to bear upon said contactor and said further contactor to move the same axially is response to relative movement of said actuator arm.

28. A movement sensing device as claimed in claim 20, wherein said further support means comprises a stretchable sleeve for fitting over and engaging the limb, said one part of said further support means being fixedly disposed at one end of said sleeve, and the other part of said support means being fixedly disposed at the opposing end of said sleeve.

29. A movement sensing device as claimed in claim 17, wherein said further sensing means comprises: an actuating arm connected at one end to said one part of said further support means; a resilient arm connected at one end to said other part of said further support means, the other ends of said actuating arm and said resilient arm being interconnected; and electrical contact means associated with said actuating arm; wherein said electrical contact means are open when said further sensing means is disposed at said first position and are closed when said further sensing means is disposed at said second position; and wherein the closing of the electrical contact means triggers actuation of said further transducer means.

30. A movement sensing device as claimed in claim 29, wherein said actuating arm is expandable and contractible independently of said resilient arm, such that flexure of the limb causes expansion of said resilient member which in turn causes expansion of said actuating arm, and straightening of the limb causes contraction of said resilient member which in turn caused retraction of said actuating arm; and said electrical contact means are fixedly disposed relative to said further support means; whereby said actuating arm causes said electrical contact means to open below a prescribed threshold of expansion, corresponding to said further sensing means being disposed at said first position, and close beyond said prescribed threshold of expansion, corresponding to said further sensing means being disposed at said second position.

31. A movement sensing device as claimed in claim 30, wherein said electrical contact means comprises a first set of contacts axially disposed in conjunction with said actuator arm; and said actuator arm includes a contactor associated with said first set of contacts, said contactor being axially moveable in response to expansion or contraction of said actuator arm to selectively contact said first set of contacts to close or open said electrical contact means dependent upon the prescribed expansion or contraction of said actuator arm disposing said further sensing means in either said second or first positions.

32. An apparatus as claimed in claim 1, wherein said movement sensing device includes contact means mounted to said support means and disposed to contact the body of the user whilst the arm is disposed at a prescribed angular position relative to the body; said sensing means being adapted to sense the contact of said contact means with the body of the user; and said transducer means being adapted to generate said signal in response to said sensing means sensing a prescribed loss of contact between said contact means and the body.

33. An apparatus as claimed in claim 1 wherein said contact means is elongated and is adapted for positioning such that the longitudinal extent thereof is disposed transversely of the arm, to maintain contact with the body throughout a range of angular movement of the arm adjacent to and across the body whilst maintaining the relative angular displacement between the arm and the body, and to mitigate contact with the body in response to the arm moving away from the body increasing the relative angular displacement between the arm and the body.

34. An apparatus as claimed in claim 1, wherein said contact means is adapted to provide for a differential change in contact relative to the degree of movement of the arm away from the body, and wherein said prescribed loss of contact corresponds to a prescribed degree of said movement.

35. An apparatus as claimed in claim 1, wherein said support means comprises a stretchable sleeve for fitting over and engaging the arm.

36. An apparatus as claimed in claim 1, wherein said further support means has one part adapted for attachment to the upper arm and the other part adapted for attachment to the lower arm; said further sensing means being mounted for connection to said one part and said other part at opposing ends thereof and for positioning to extend over the elbow, said further sensing means being capable of expanding from a first position, where the arm is relatively straight, in response to flexure of the elbow, to and beyond a second position, where the arm is bent, and contracting back to said first position in response to straightening of the arm; and said further transducer means being adapted for generating said further signal in response to a predetermined expansion of said further sensing means to said second position.

37. A method for aiding a golf swing like motion comprising the steps of:

fitting a support to the leading arm of the user proximate to the proximal end of the arm adjacent to the body of the user;

sensing any loss of contact between the upper portion of the leading arm and the body throughout a range of movement of the leading arm adjacent to and across the body during a golf swing; and generating a signal in response to sensing a prescribed loss of contact between the upper portion of the leading arm and the body at any time during a prescribed range of movement of the leading arm during the golf swing.

38. A method as claimed in claim 37, including:

fitting a further support to the leading arm of the user adjacent to or coincident with the elbow thereof in conjunction with said support;

sensing flexure of the elbow during movement of the leading arm throughout the golf swing in addition to sensing the loss of contact between the upper of the leading arm and the body; and generating a further signal in response to flexure of the arm beyond a prescribed degree.

39. A method as claimed in claim 38, including ceasing generation of the further signal in response to flexure beyond a prescribed upper limit.

40. A method as claimed in claim 39, including ceasing generation of the signal in response to sensing flexure beyond a prescribed upper limit.

* * * * *